United States Patent [19]

Hunter

[11] 3,946,960

[45] Mar. 30, 1976

[54] WIND-UP DEVICE FOR TIRE CORD FABRIC

[75] Inventor: Edward E. Hunter, Akron, Ohio

[73] Assignee: The Goodyear Tire & Rubber Company, Akron, Ohio

[22] Filed: Feb. 19, 1975

[21] Appl. No.: 551,228

[52] U.S. Cl. ..... 242/65

[51] Int. Cl.[2] ..... B65H 17/08

[58] Field of Search ..... 242/65, 67.1 R, 67.3 R

[56] References Cited

UNITED STATES PATENTS

| | | | |
|---|---|---|---|
| 2,057,191 | 10/1936 | Huffine | 242/67.1 R |
| 3,586,253 | 6/1971 | Gilbank | 242/65 |
| 3,610,545 | 10/1971 | Reifenhauser | 242/65 |

*Primary Examiner*—Edward J. McCarthy
*Attorney, Agent, or Firm*—F. W. Brunner; H. E. Hummer

[57] ABSTRACT

A device for coiling a sheet of wire tire cord fabric under a predetermined desired tension to produce a roll of tire cord fabric which is appropriately wound free of ruffles or bagginess. The device has a take-up roll on which the fabric is coiled, a drive roll for rotating the take-up roll, and means for causing relative movement of the rolls to maintain a predetermined pressure between fabric on the take-up roll and the drive roll, as the roll of fabric increases in size and weight. An idler roll is disposed adjacent the take-up roll for first engaging the fabric, changing its directional movement and guiding it immediately onto the take-up roll. Paper is directed between annular layers of the roll of fabric to separate the fabric and prevent any distortion of it.

9 Claims, 2 Drawing Figures

WIND-UP DEVICE FOR TIRE CORD FABRIC

BACKGROUND OF THE INVENTION

The invention is designed to produce a good inexpensive wind-up device which can be used with a conventional loom for weaving tire cord fabric of metal warp cords and textile weft threads. There are various mechanisms presently employed for winding up fabric. Some devices employ a center drive for rotating the take-up roll, or drum upon which the fabric is being coiled. Such devices are not very efficient in forming a roll of fabric woven from wire warp cords. Other, more sophisticated apparatuses employ two separate drive rolls in combination with a take-up roll, one of the drive rolls acting to pull fabric onto the take-up roll at a certain linear speed, and the other of the drive rolls utilized for driving the take-up roll at a speed greater than the linear speed of the fabric as it moves onto the take-up roll, thereby tensioning the fabric to eliminate any ruffles or bagginess in the fabric during the formation of a roll of fabric. The mechanism employing two drive rolls works well, but is expensive to fabricate, thus making its use with conventional weaving equipment, from a cost standpoint, not justifiable. The invention is directed to solving the problem by providing a different wind-up device which is comparatively inexpensive to manufacture and operates to produce a well coiled roll of tire cord fabric.

Briefly stated, the invention is in a device for winding up, or coiling a sheet of tire cord fabric. The wind-up device comprises a take-up roll on which a sheet of fabric is coiled, and a drive roll positioned adjacent the take-up roll for rotating the take-up roll in a rotary direction for coiling the fabric. Means are provided for causing relative movement of these rolls to maintain, as closely as possible, a predetermined pressure between the roll of fabric on the take-up roll and the drive roll, as the roll of fabric increases in size and weight. An idler roll is disposed adjacent the take-up roll for first engaging and changing the directional movement of the fabric and guiding the fabric immediately onto the take-up roll. The idler roll is rotated by the fabric as it passes onto the take-up roll and in a rotary direction which is opposite that of the take-up roll. The idler roll is designed to rotate about its own longitudinal axis which is parallel to the rotational axes of the take-up and drive rolls.

DESCRIPTION OF THE DRAWING

The following description of the invention will be better understood by having reference to the annexed drawing, wherein.

DESCRIPTION OF THE INVENTION

Figure 1:
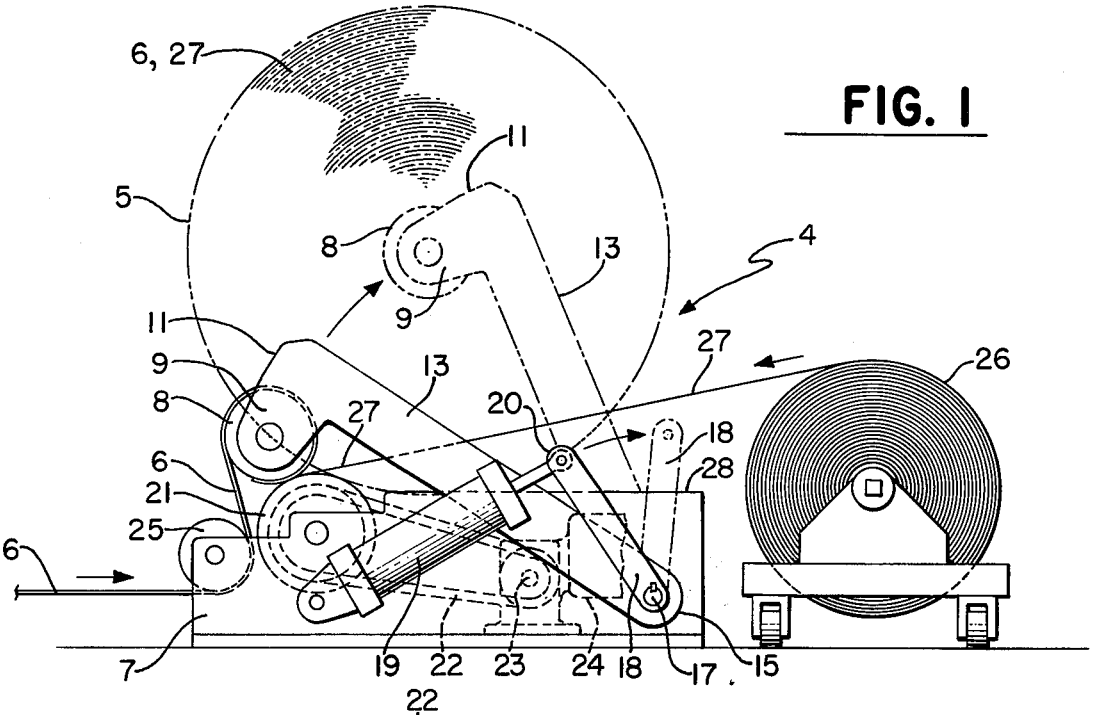
FIG. 1 is a side view of a wind-up device made in accordance with the invention.
Figure 2:
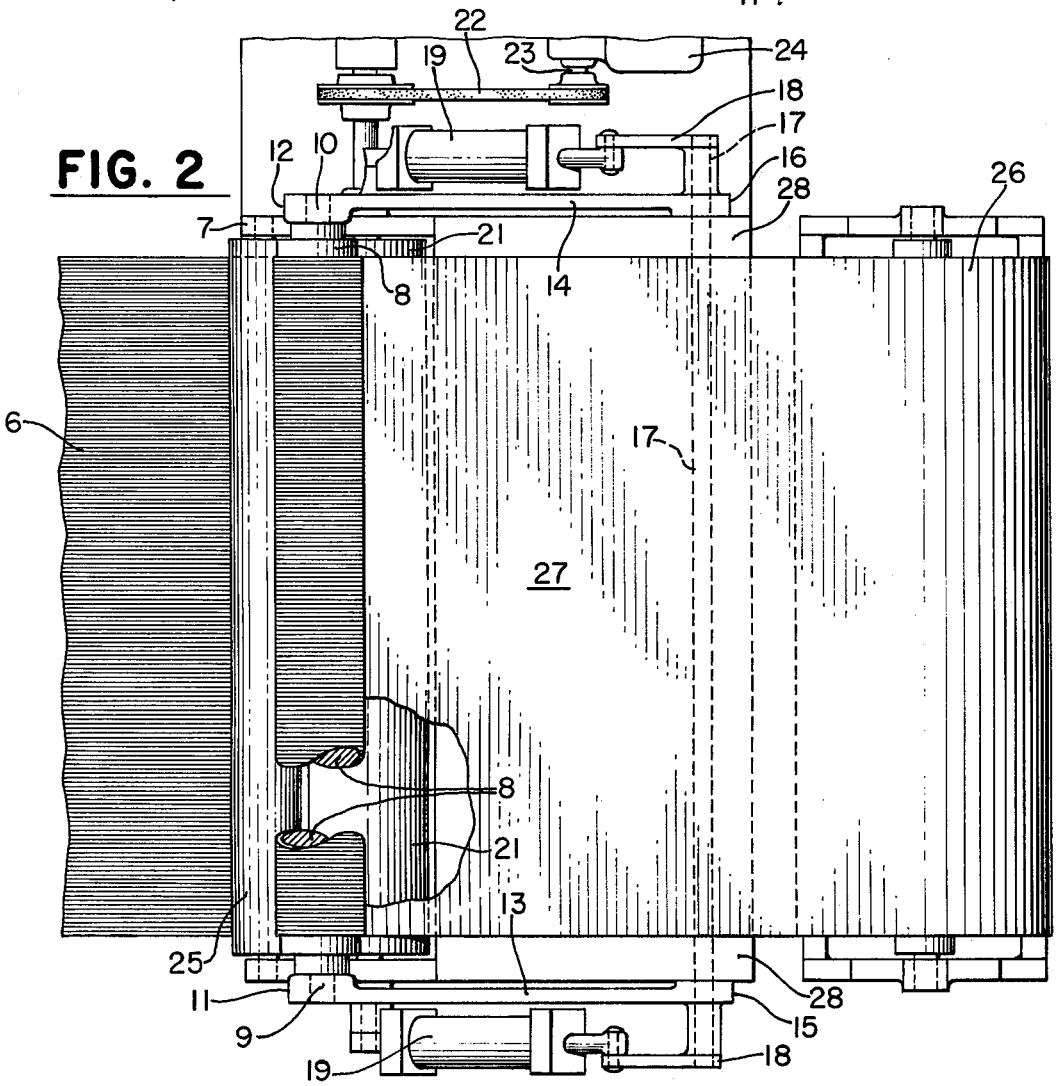
FIG. 2 is a plan view of the wind-up device.

Referring more particularly to the drawing, there is shown a wind-up device 4 for forming a roll 5 of tire cord fabric 6 received from a conventional loom and woven from metal warp cords and textile weft threads. The wind-up device 4 comprises a stationary frame 7 which supports a take-up roll 8 on which the tire cord fabric 6 is spirally wound, or coiled.

The take-up roll is rotatably mounted between a couple of brackets 9 and 10 which are disposed at the free distal ends 11 and 12 of a pair of parallel support arms 13 and 14 that extend from the stationary frame 7. The proximal ends 15 and 16 of support arms 13 and 14 are secured to a shaft 17 which is journalled in the stationary frame 7 for rotation about an axis that is parallel to the rotational axis of the take-up roll 8 which is designed to rotate freely about its own longitudinal axis.

A lever arm 18 is keyed to each of the support arms 13 and 14. An air cylinder 19 is coupled between the stationary frame 7 and the distal end 20 of each of the lever arms 18 for rotating the lever arms 18 and attached support arms 13 and 14, in unison.

A drive roll 21 is mounted on the stationary frame 7 for rotation about its own longitudinal axis which is also parallel to the rotational axis of the take-up roll 8. The drive roll 21 is designed to engage and at least partially support the take-up roll 8 at all times during the formation of the roll 5 of tire cord fabric 6. The drive roll 21 is operatively connected by a belt 22 to the shaft 23 of any suitable motor 24 used for rotating the drive roll 21.

An idler roll 25 is also mounted on the stationary frame 7 for rotation about its own longitudinal axis which is parallel to the rotational axes of the take-up and drive rolls 8 and 21. The idler roll 25 rotates freely about its own axis, and is positioned downstream from the take-up roll 8 to first contact and guide the tire cord fabric 6 immediately onto the take-up roll 8. The idler roll 25 changes the directional movement of the tire cord fabric 6 and is closely spaced to the drive roll 21. The idler roll 25 is positioned on the stationary frame 7, such that the tire cord fabric 6 moves generally in a vertical direction between the idler roll 25 and take-up roll 8. Thus, the tension in the fabric 6 acts as a vertical component of force to press the take-up roll 8 downwardly against the drive roll 21.

A let-off roll 26 of paper 27 is positioned adjacent the stationary frame 7 in alignment with the tire cord fabric 6 as it moves toward the idler roll 25. The paper 27 is reeved around the take-up roll 8 under the tire cord fabric 6. Thus, the paper 27 acts to separate adjacent, annular layers of tire cord fabric 6 on the roll 5. The intermediate layers of paper 27 prevent distortion of the wire woven fabric 6, and are not needed for rolls of tire cord fabric woven entirely of textile warp cords and weft threads.

In operation, the ends of the roll 26 of paper 27 and tire cord fabric 6 are first secured to the take-up roll 8, as best seen in FIG. 1, the tire cord fabric 6 being partially reeved around the idler roll 25. The drive roll 21 is then operated to rotate the take-up roll 8 to wind up both the tire cord fabric 6 and paper 27 around the take-up roll 8. The tire cord fabric 6 is tensioned to eliminate any bagginess or ruffles in the fabric 6 as it is being coiled around the take-up roll 8. Pressure on the tire cord fabric 6 is also an important factor in eliminating distortion of the fabric. Therefore, it is important to maintain a certain desired pressure between the roll 5 of tire cord fabric 6 and the drive roll 21 which engages and presses against the fabric 6 being wound on the take-up roll 8. It can be appreciated that any increase in the weight of the roll 5 of tire cord fabric 6 changes the compressive relationship between the fabric 6 and drive roll 21. Thus, in the beginning, the support arms 13 and 14 are rotated toward the rotational axis of the drive roll 21 to press the take-up roll 8 and fabric 6 thereon firmly against the drive roll 21. Then, as the roll 5 of tire cord fabric 6 becomes increasingly larger, the support arms 13 and 14 are rotated from the rotational axis of the drive roll 21 to maintain, as nearly as possible, a uniform desired pressure between the roll 5 of fabric 6 and drive roll 21. When the roll 5 of tire cord fabric 6 is complete, as seen in dotted line of FIG. 1, the take-up roll 8 is released from the brackets 9 and 10 of the support arms 13 and 14 onto an adjacent platform 28 on the stationary frame 7. The platform 28 is preferably horizontally disposed for supporting the completed roll 5 of tire cord fabric 6, until a movable dolly or truck for transporting the roll 5 of tire cord fabric 6, can be positioned adjacent the platform 28 for receiving and removing the roll 5 of tire cord fabric 6 from the wind-up device 4.

Thus, there has been described a fabric wind-up device which employs a single drive roll in combination with an idler roll for properly tensioning the fabric as it is being coiled into a roll to eliminate any bagginess or ruffles in the fabric. The idler and drive rolls are composed of metal, rather than rubber, for best performance.

What is claimed is:

1. A device for winding up a sheet of tire cord fabric, comprising:

a. a take-up roll on which a sheet of fabric is coiled;

b. a drive roll adjacent the take-up roll for rotating the take-up roll in a direction for coiling fabric thereon;

c. means for mounting the drive roll for at least partially supporting the take-up roll and fabric coiled therearound;

d. means for causing relative movement of the rolls to maintain, as closely as possible, a predetermined pressure between fabric on the take-up roll and the drive roll, as the roll of fabric increases in size and weight;

e. an idler roll adjacent the take-up roll for first engaging the fabric and guiding it immediately on to the take-up roll, the idler roll being rotatable freely about its own axis by the fabric as it moves on to the take-up roll and in a rotary direction which is opposite that of the take-up roll; and f. means for mounting the idler roll vertically below the take-up roll for guiding fabric upwards from the idler roll to the take-up roll in a plane which is angularly disposed to the horizontal.

2. The device of claim 1, wherein the means for causing relative movement of the take-up and idler rolls includes:

h a pair of parallel arms for supporting the take-up roll therebetween;

i means for mounting the support arms for unitary reciprocating movement to and from the rotational axis of the drive roll;

j means for mounting the take-up roll for rotating freely between the support arms; and k means for reciprocating the support arms, in unison.

3. The device of claim 2, wherein the means (k) for reciprocating the support arms includes at least one lever arm keyed to the support arms for unitary rotational movement, and means coupled to the lever arm for rotating it.

4. The device of claim 2, which includes:

m a let-off roll on which is coiled a sheet of material for separating adjacent layers of fabric on the take-up roll; and n means for placing the fabric on the sheet of material, prior to coiling the fabric and material together on the take-up roll.

5. The device of claim 2, wherein the rotational axes of the drive and idler rolls are disposed vertically below the take-up roll.

6. The device of claim 5, wherein the rotational axes of the drive and idler rolls are, in that order, successively, vertically below the take-up roll.

7. The device of claim 2, which includes a platform disposed adjacent the take-up roll and designed to receive and support a roll of fabric released from the support arms.

8. The device of claim 7, wherein the platform is horizontally disposed adjacent a roll of fabric wound on the take-up roll.

9. The device of claim 8, which includes:

o a let-off roll on which is coiled a sheet of material for separating adjacent layers of fabric on the take-up roll; and p means for placing the fabric on the sheet of material, prior to coiling the fabric and material together on the take-up roll.

* * * * *